United States Patent [19]

Köurimsky et al.

[11] 4,447,102

[45] May 8, 1984

[54] ELECTRICAL CONNECTOR ASSEMBLIES

[75] Inventors: Friedrich J. A. Köurimsky, Bensheim, Fed. Rep. of Germany; Werner Lothmann, Ascot, England

[73] Assignee: AMP Incorporated, Harrisburg, Pa.

[21] Appl. No.: 358,142

[22] Filed: Mar. 15, 1982

[30] Foreign Application Priority Data

Mar. 18, 1981 [GB] United Kingdom ..... 8108538

[51] Int. Cl.[3] ..... H01R 13/62

[52] U.S. Cl. ..... 339/91 R

[58] Field of Search ..... 339/91 R; 403/321, 322, 403/330

[56] References Cited

U.S. PATENT DOCUMENTS

| | | | |
|---|---|---|---|
| 3,133,777 | 5/1964 | Anhalt | 339/91 R |
| 3,628,812 | 12/1971 | Larralde et al. | 403/322 |
| 3,851,984 | 12/1974 | Crippa | 403/322 |
| 4,265,503 | 5/1981 | Baur | 339/91 R |
| 4,285,563 | 8/1981 | Crosier et al. | 339/75 M |

*Primary Examiner*—John McQuade
*Assistant Examiner*—Gary F. Paumen
*Attorney, Agent, or Firm*—F. W. Raring

[57] ABSTRACT

A two-part electrical connector assembly (11, 12) has a channel-shaped latching arm (26) mounted with its limbs (27) straddling one connector (11) and slidable in a slot (25) between walls (16, 33) of the connectors (11, 12). Ends of the limbs (27) are formed with apertures (31) adapted to engage resilient detents (35) on the other connector (12) when the latching member (26) is retracted about the connector (11) to latch the connectors together. The limbs (27) having slots (28) engaging projections (23) on the one connector (11) to permit movement of the latching member (26) from the retracted latching condition to an extended position, remote from the detents (35) where it serves as a handle for manual disengagement of the connectors (11, 12).

6 Claims, 7 Drawing Figures

FIG.4.
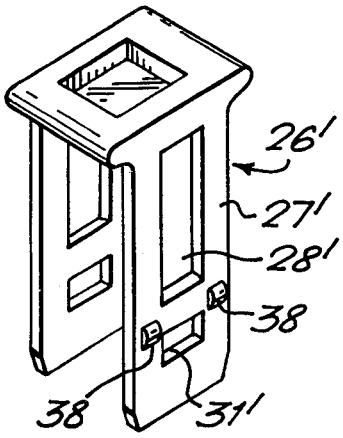
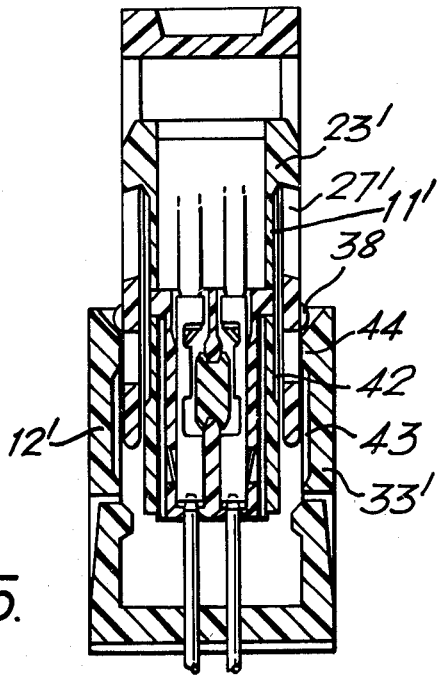
FIG.6. FIG.5.
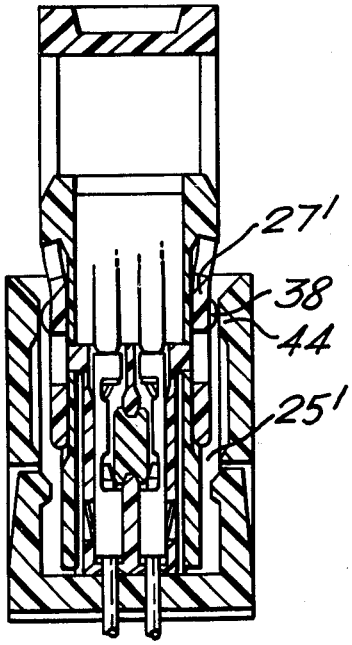
FIG.7.
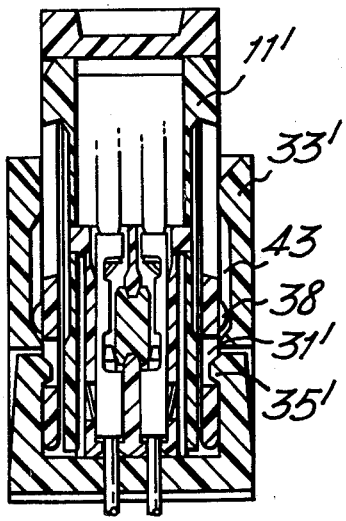

ELECTRICAL CONNECTOR ASSEMBLIES

The invention relates to electrical connector assemblies.

It is often required to mount electrical connector assemblies closely adjacent in a row to occupy a minimum of space and yet to remove individual connectors when necessary for insertion or replacement without requiring specialized tools.

It is an object to provide a latching male and female connector assembly with improved facility for connection and disconnection when arranged closely adjacent to other connector assemblies in a row.

An electrical connector assembly according to the invention comprises male and female connectors with contacts mateable by moving the connectors together and a latching arm mounted on one connector for movement between an extended, release position and a retracted latching position, respectively remote from and adjacent the connectors when mated, the latching arm and the other connector having complementary latching means engageable by moving the latching arm to the retracted position, releasably to latch the male and female connectors together.

When in the extended, release, position the latching arm provides a handle by which the connectors can be manually moved apart whilst the assembly occupies a minimum of space when the latching arm is in the retracted latching position.

The connector assemblies are particularly suitable for mounting in a row closely adjacent one another on a circuit board. Extension of the latching arm facilitates connector handling as it enables an individual connector to be removed manually from the row without need for an extraction tool and the connector to be readily realigned with a mating connector for reconnection. In addition, latching of the connectors together and mating of the contacts can occur at different times requiring less force than if they occured simultaneously.

Preferably, the latching means includes a latching detent extending into the path of movement of the latching arm and depressible to a release condition by engagement with the latching arm on movement of the latching arm between the extended and retracted positions.

The latching arm may be of generally channel-section and mounted with the limbs straddling one connector for sliding movement along the slot, perpendicularly to the channel. Conveniently, free ends of the limbs are formed with eyes engageable with respective latching detents which are provided on the other connector.

Desirably, the male and female connectors include housings adjacent walls of which together define a slot and the latching arm may be mounted on the one connector for sliding movement progressively into the slot from the extended, release, position to the retracted, latching position.

Interengageable stop means may be provided on the latching arm and a housing wall at a location adjacent a mouth of the slot to prevent sliding movement of the latching arm fully into the slot into the latching position prior to movement together of the male and female connectors into a fully mated condition.

The stop means may include detent means on one side of the latching arm engageable with a stop portion of the wall on the other housing, a recess being formed in the one housing wall at a location remote from a mating face, the arrangement being such that, movement of the male and female connectors into a fully mated condition advances the recess to underlie the detent means permitting the detent means to resile over the stop portion to permit the latching arm to be inserted fully into the slot into the latching position. The wall of the other housing may be suitably rebated to receive the protuberances thereby providing clearance for the latching arm to be advanced into the fully latched condition.

Examples of electrical connector assemblies according to the invention will now be described with reference to the accompanying drawings in which:

FIG. 4 is a perspective view of a latching arm of a modified connector assembly;

FIG. 5 is a transverse cross-section view of the modified connector assembly with male and female connectors aligned for mating and the latching arm fully extended from the female connector;

FIG. 6 is a similar view to FIG. 5 showing the male and female connectors in fully mated condition and the latching arm during its advance towards the latching condition; and FIG. 7 is a similar view to FIG. 6 showing the latching arm in the fully retracted, latching condition.

Figure 1:
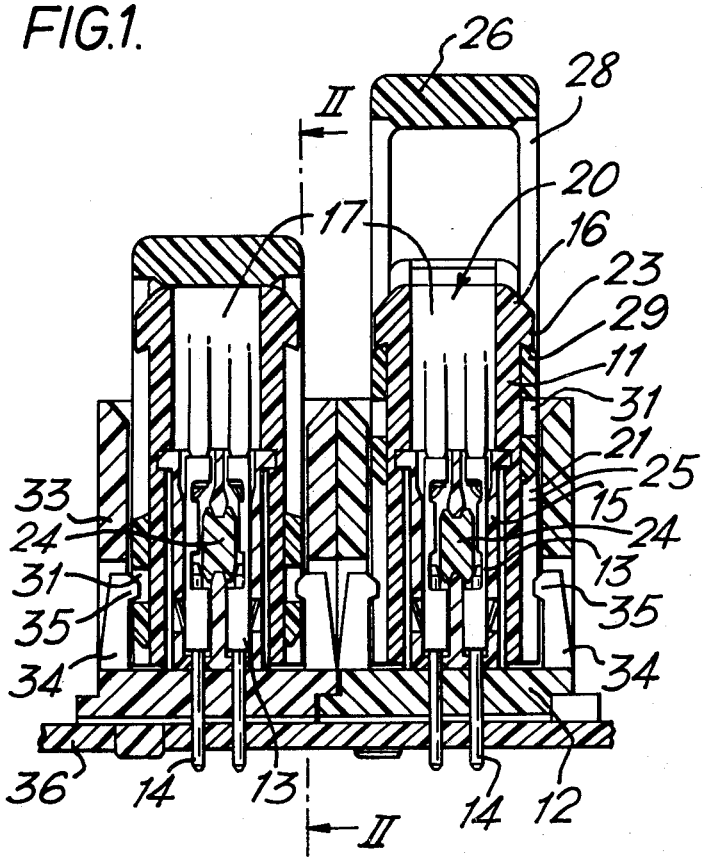
FIG. 1 is a transverse cross-sectional view of a first example of connector assembly.
Figure 3:
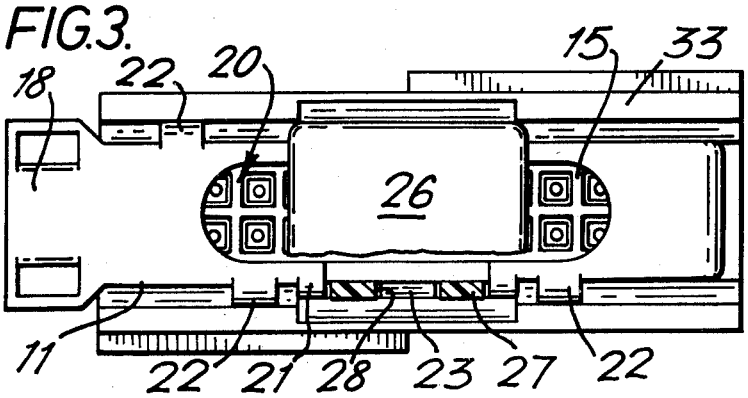
FIG. 3 is a plan view, partly broken away.
Figure 2:
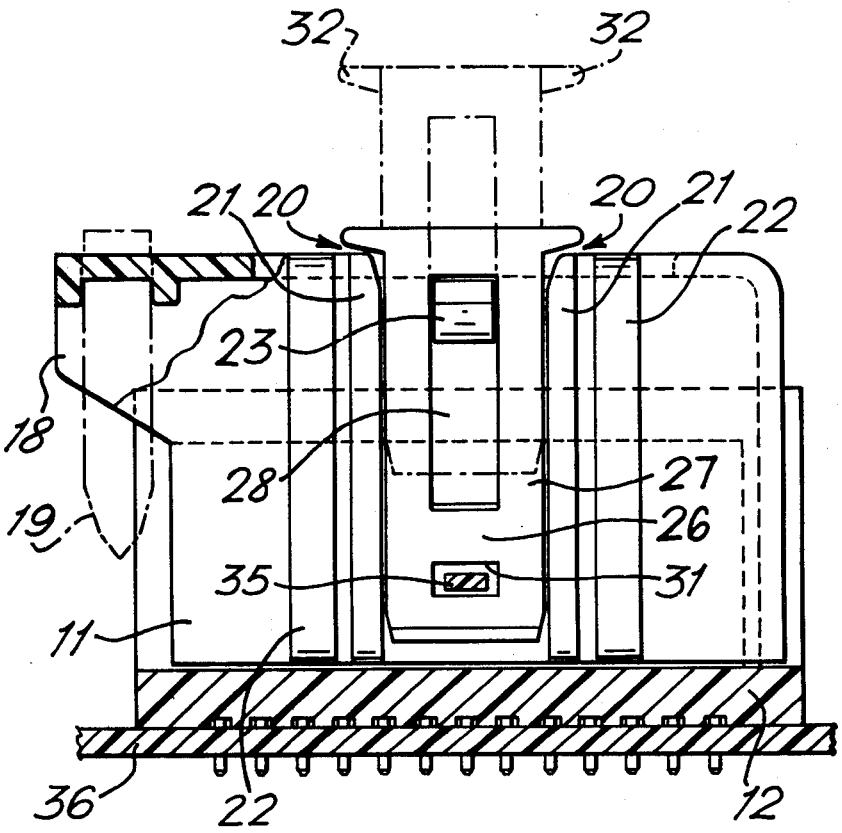
FIG. 2 is a cross-sectional view of the first example of connector assembly taken along line II—II of FIG. 1.

The connector assembly of FIG. 1 comprises male and female connectors 11 and 12, respectively having female and male contacts 13 and 14. The contacts 13 are latched in an insulating block 15, fixed in a forward mating face of a male housing shell 16 by a longitudinally slidable latching bar 24. A rear part of the housing shell provides a cavity 17 for a bundle of wires (not shown) terminated in respective contacts 13, and a cable shroud 18 (FIG. 2). A cable tie 19 (shown in broken lines in FIG. 2) may be fixed to the cable shroud 18 to secure the wire bundle which is led from the connector leftwardly below the cable shroud 18 as seen in FIG. 2. The cavity 17 communicates with a rear aperture 20. A pair of spaced, parallel guiding ribs 21 extend externally from the rear to the forward face of the housing shell 16 on each side of the housing shell 16 and each side of the housing shell 16 is provided with parallel polarising ribs 22. A latching projection 23 is formed on each side of the housing shell between the guiding ribs 21 adjacent the rear face.

A latching arm 26 of generally U-shape includes a pair of limbs 27 straddling the housing shell 29. Each limb is formed with a longitudinally extending slot 28 receiving the latching projection 23, permitting the latching arm to be moved between extended and retracted positions in which the rim 29 of the slot and the base of the latching arm 26 respectively, engage the latching projection 23 and the housing shell 16, limiting such movement. Latching eyes or openings 31 are formed in the free ends of each limb 27. The base of the latching arm is extended axially to provide finger-engageable protuberances 32 overlying the aperture 20.

The female connector 12 is moulded in one piece of plastics material and provides a channel-section receptacle of greater width than the male housing shell. The side walls 33 of the channel are formed adjacent the base with inwardly projecting detents 34 having chamfered latching noses 35.

In use of the connector assembly, several female connectors 12 are mounted adjacent each other on a panel board 36. A connector 11 can then be mated with a female connector with the latching arms 28 in an extended position. When the male and female contacts 11 and 12, respectively, are fully mated, that latching arm is pushed along a slot 25 defined between the male housing shell 16 and the wall 33 of the female housing until the latching noses 35 of detents 34 enter the eyes 31 releasably to latch the male and female housings together. Engagement of the finger-engageable portions 32 overlying the aperture 20 between finger tip and thumb enables the selected latching arms 26 to be pulled back to unlatch the housings. The latching arm can be fully gripped in its extended position to unmate the contacts.

In the modified example of the connector assembly shown in FIGS. 4 to 7, protuberances 38 are formed on each limb 27' of the latching arm 26' at locations between the slots 28' and the eyes 31'. Opposite walls of the male housing shell 11' are each formed with a recess 42 underlying a limb 27' and extending from a location spaced from the mating face to the latching projection 23'. Rebates 43 are formed in the side walls 33' of the female housing 12' in alignment with the protuberances 38 defining stop portions 44 at the mouth of the famale housing 12'.

Mating of the modified male and female connectors is achieved in a similar manner to that described above in connection with the first example of connector assembly except that, prior to advancing the male connector into a fully mated condition with female connector if the latching arm is not fully extended, the protuberances 38 engage the stop portions 44 to prevent further advance of the latching arm into the female housing 12 and premature latching (FIG. 5). The abutment of the free ends of the limbs 27 with the wall portion of the male housing located forward of the recess 42 prevents the protuberances 38 from overriding the stop portion 44.

Further advance of the male housing to the fully mated condition brings the recesses 42 into alignment with the free ends of the limbs 27' permitting them to resile into the recesses and the protuberances 38 to override the stop portions 44 with a detent action and enter the rebates 43 which provide clearance for the latching arm to be advanced into the fully retracted, latching condition.

What is claimed is:

1. An electrical connector assembly comprising male and female connectors with contacts mateable on mating movement of the connectors together and a latching arm mounted on one connector, characterised in that the latching arm (26) is slidably mounted on the one connector (11) and is movable between an extended, release position and a retracted latching position, respectively remote from and adjacent the connectors (11 and 12) when mated, the latching arm (26) and the other connector (12) having complementary latching means (31 and 34) engageable on moving the latching arm (26) to the retracted position, releasably to latch the male and female connectors (11 and 12) together, and the latching means (31 and 34) includes a latching detent (34) extending into the path of movement of the latching arm (26) and depressible to a release condition by engagement with the latching arm (26) on movement of the latching arm (26) between the extended and retracted positions.

2. An electrical connector assembly according to claim 1, characterised in that the latching arm (26) is of generally channel-section having a pair of limbs (27) and is mounted with the limbs (27) straddling one connector (11) for sliding movement perpendicularly to the channel, free ends of the limbs (27) being formed with openings (31) engageable with respective latching detents (34) provided on the other connector (12), the labeling means comprising the latching detents and the openings.

3. An electrical connector assembly as claimed in claim 2, characterised in that the limbs (27) are formed with slots (28) engaging projections (23) on the one connector (11) at a location remote from a mating face, and arranged to permit relative sliding of the latching member (26) and the connector (11) between the retracted and extended positions.

4. An electrical connector assembly according to claim 1, characterised in that the male and female connectors (11 and 12) comprise housing walls (16, 33) which together define a slot (25) and the latching arm (27) is mounted on the one connector (12) for sliding movement progressively into the slot (25) from the extended, release position to the retracted, latching position.

5. An electrical connector assembly as claimed in claim 4, characterised in that interengageable stop means (38, 44) are provided on the latching arm (27') and an adjacent connector housing wall (33') at a location adjacent a mouth of the slot (25') adapted to resist movement of the latching arm (27') into the slot (25') to the latching position until the connectors (11', 12') are fully mated.

6. An electrical connector assembly as claimed in claim 5, characterised in that the stop means (38, 44) comprise a detent (38) on the latching arm (27') and a stop (44) on the wall (33') of the other housing (12'), a recess (42) being formed in the one housing (11'), at a location remote from the mating face, the arrangement being such that movement of the connectors (11', 12') into a fully mated condition positions the recess (42) to underlie the detent (38) and permit the detent (38) to resile over the stop (44) by flexure of the latching arm (27') into the recess (42) and allow full insertion of the latching arm (27') into the slot (25') into the latching, retracted position.

* * * * *